US008651014B2

(12) United States Patent
Vidojevic et al.

(10) Patent No.: US 8,651,014 B2
(45) Date of Patent: Feb. 18, 2014

(54) FIRE CONTAINMENT SYSTEM

(75) Inventors: Nenad Vidojevic, Chesterton, IN (US); Gilbert J. Evers, St. John, IN (US)

(73) Assignee: C. Cretors & Company, Chicago, IL (US)

( * ) Notice: Subject to any disclaimer, the term of this patent is extended or adjusted under 35 U.S.C. 154(b) by 512 days.

(21) Appl. No.: 12/417,261

(22) Filed: Apr. 2, 2009

(65) Prior Publication Data

US 2009/0229473 A1 Sep. 17, 2009

Related U.S. Application Data

(62) Division of application No. 11/340,070, filed on Jan. 26, 2006, now abandoned.

(51) Int. Cl.

| | |
|---|---|
| ***A23L 1/18*** | (2006.01) |
| ***F24D 3/16*** | (2006.01) |
| ***F24F 3/14*** | (2006.01) |
| ***F25B 29/00*** | (2006.01) |
| ***A21B 1/00*** | (2006.01) |
| ***A21B 1/22*** | (2006.01) |

(52) U.S. Cl.

USPC ..... 99/323.5; 165/56; 165/60; 165/61; 165/65; 219/400

(58) Field of Classification Search

USPC ..... 169/65, 46, 56, 60, 61, 70; 219/400, 219/620–677; 99/323.4, 323.5, 323.9, 99/323.6, 323.7, 323.8, 324; 220/293, 220/297, 300, 301

See application file for complete search history.

(56) References Cited

U.S. PATENT DOCUMENTS

| | | | | | |
|---|---|---|---|---|---|
| 1,436,400 | A | | 11/1922 | Mabey | |
| 1,477,704 | A | | 12/1923 | Holcomb et al. | |
| 1,501,114 | A | | 7/1924 | Howe | |
| 1,827,194 | A | * | 10/1931 | Grothe | 432/199 |
| 1,961,812 | A | | 6/1934 | Burch | |
| 1,987,388 | A | | 1/1936 | Cretors | |
| 2,123,663 | A | | 7/1938 | Roach | |
| 2,232,954 | A | * | 2/1941 | Manley | 99/323.9 |
| 2,237,237 | A | * | 4/1941 | Scoggin et al. | 110/190 |
| 2,248,812 | A | | 7/1941 | Cretors | |
| 2,254,271 | A | * | 9/1941 | Cretors | 99/323.9 |
| 2,477,416 | A | | 7/1949 | Page | |
| 2,549,449 | A | | 4/1951 | Gibson | |

(Continued)

OTHER PUBLICATIONS

Catalog Pages, Blowers, 10 CFM, 30 to 50 CFM, 390 to 1420 CFM and 90 CFM, Fasco, Copyright 2005.

(Continued)

*Primary Examiner* — Henry Yuen
*Assistant Examiner* — Eric Stapleton
(74) *Attorney, Agent, or Firm* — Perkins Coie LLP

(57) ABSTRACT

A fire containment system and method is disclosed. The fire containment system is designed to assist in temporarily containing a fire within a semi-enclosed space having an open side for operator access. An exhaust air blower exhausts air from the semi-enclosed space through an exhaust vent. An inlet air blower provides air to the semi-enclosed space through an inlet vent. In the case of a fire in the semi-enclosed space, the fire will be drawn away from the open side and toward the inlet vent due to the air supplied by the inlet air blower. The fire is thus encouraged to remain within the semi-enclosed space, allowing additional time for a fire suppression mechanism to be activated.

19 Claims, 7 Drawing Sheets

(56) References Cited

U.S. PATENT DOCUMENTS 2,570,126 A 10/1951 Hobbs
2,586,347 A 2/1952 Kloster
2,654,823 A 10/1953 Altemiller
2,738,742 A * 3/1956 Campbell ..... 110/190
2,812,704 A 11/1957 Hawks
2,856,841 A 10/1958 Cretors et al.
2,858,761 A 11/1958 Denniss
2,907,264 A 10/1959 Bushway
2,939,379 A 6/1960 Schmitt
2,950,669 A * 8/1960 Terry ..... 99/421 H
2,984,169 A 5/1961 Bushway
3,068,812 A * 12/1962 Hemeon ..... 110/345
3,095,326 A 6/1963 Green et al.
3,120,168 A 2/1964 Lippert
3,140,952 A 7/1964 Cretors
3,272,111 A 9/1966 Cretors
3,275,012 A * 9/1966 Howard et al. ..... 137/76
3,448,808 A * 6/1969 Olson et al. ..... 169/59
3,450,068 A 6/1969 Temple
3,463,233 A * 8/1969 Haessler ..... 169/47
3,512,989 A 5/1970 Smith
3,524,403 A * 8/1970 Johnson et al. ..... 99/331
3,554,115 A 1/1971 Manley et al.
3,568,782 A 3/1971 Cox
3,653,443 A * 4/1972 Dockery ..... 169/61
3,678,487 A * 7/1972 Ludewig et al. ..... 340/507
3,697,289 A * 10/1972 Day ..... 426/625
3,739,953 A 6/1973 Cretors
3,783,854 A * 1/1974 Hurko et al. ..... 126/21 R
3,812,774 A * 5/1974 Day et al. ..... 99/323.8
3,884,135 A * 5/1975 Lohr et al. ..... 99/348
3,930,996 A 1/1976 Day et al.
3,933,145 A * 1/1976 Reich ..... 126/25 R
4,089,632 A * 5/1978 Rexroad ..... 431/21
4,120,236 A 10/1978 Blomberg
4,165,620 A 8/1979 Gehauf nee Kiesel et al.
4,173,925 A 11/1979 Leon
4,178,843 A 12/1979 Crabtree et al.
4,182,229 A 1/1980 VandeWalker
4,206,695 A 6/1980 Cretors
4,288,686 A 9/1981 Cretors
4,331,124 A 5/1982 Seidel et al.
4,380,146 A * 4/1983 Yannone et al. ..... 60/790
4,438,682 A 3/1984 King et al.
4,512,247 A 4/1985 Friedman
4,527,542 A 7/1985 Bales et al.
4,648,719 A 3/1987 Roben et al.
4,649,263 A 3/1987 Goodlaxson
4,649,834 A * 3/1987 Heran et al. ..... 110/190
4,708,069 A * 11/1987 Kidd ..... 110/275
4,751,886 A * 6/1988 Koptis et al. ..... 110/190
4,763,568 A 8/1988 Kiczek
4,773,485 A * 9/1988 Silverman ..... 169/65
4,813,487 A * 3/1989 Mikulec et al. ..... 169/65
4,815,524 A * 3/1989 Dempsey et al. ..... 165/245
4,830,116 A * 5/1989 Walden et al. ..... 169/65
4,834,188 A * 5/1989 Silverman ..... 169/65
4,877,011 A * 10/1989 Willice ..... 126/25 R
4,902,520 A * 2/1990 Dysarz ..... 426/107
4,903,685 A * 2/1990 Melink ..... 126/299 D
4,934,260 A * 6/1990 Blevins ..... 99/482
4,951,648 A * 8/1990 Shukla et al. ..... 126/21 A
4,979,572 A * 12/1990 Mikulec ..... 169/65
4,987,958 A * 1/1991 Fierbaugh ..... 169/57
5,033,363 A 7/1991 King et al.
5,035,173 A 7/1991 Stein et al.
5,039,006 A * 8/1991 Habegger ..... 236/11
5,046,481 A 9/1991 Warwick
5,083,505 A 1/1992 Kohlstrung et al.
5,127,479 A * 7/1992 Stehling et al. ..... 169/65
5,129,386 A * 7/1992 Meister ..... 126/299 R
5,154,159 A * 10/1992 Knafelc et al. ..... 126/25 R
5,154,161 A 10/1992 Rogers et al.
5,163,357 A * 11/1992 Felknor et al. ..... 99/323.5
5,203,256 A 4/1993 Mueller
5,241,947 A * 9/1993 Sandolo ..... 126/21 A
5,261,598 A * 11/1993 Shirayanagi et al. ..... 236/21 B
5,263,642 A * 11/1993 Orchard ..... 236/46 B
5,297,636 A * 3/1994 North ..... 169/65
5,301,601 A 4/1994 Cretors
5,311,930 A * 5/1994 Bruenn ..... 165/102
5,315,919 A 5/1994 Hoeberigs
5,339,726 A 8/1994 Poulson
5,347,103 A * 9/1994 LeMieux ..... 219/400
5,351,760 A * 10/1994 Tabor, Jr. ..... 169/65
5,352,867 A * 10/1994 Shota ..... 219/497
5,361,686 A * 11/1994 Koopman ..... 99/421 H
5,397,219 A 3/1995 Cretors
5,417,148 A 5/1995 Cavallo
5,419,239 A 5/1995 Covington et al.
5,429,110 A * 7/1995 Burke et al. ..... 126/25 R
5,445,073 A * 8/1995 Gilwood ..... 99/427
5,492,055 A * 2/1996 Nevin et al. ..... 99/331
5,501,139 A 3/1996 Lee et al.
5,555,792 A * 9/1996 Stein et al. ..... 99/323.9
5,567,143 A * 10/1996 Servidio ..... 431/22
5,579,681 A 12/1996 Ubert et al.
5,590,582 A 1/1997 Weiss
5,605,091 A 2/1997 Garber
5,642,784 A * 7/1997 Guay et al. ..... 169/61
5,662,024 A * 9/1997 Cretors et al. ..... 99/323.7
5,690,018 A 11/1997 Hansen
5,694,830 A * 12/1997 Hodgson et al. ..... 99/323.7
5,697,450 A * 12/1997 Stehling et al. ..... 169/65
5,743,172 A 4/1998 Weiss et al.
5,771,779 A 6/1998 Stein et al.
5,787,798 A 8/1998 Stein et al.
5,868,205 A * 2/1999 Cunningham et al. ..... 169/65
5,871,792 A 2/1999 Weiss et al.
5,928,550 A * 7/1999 Weiss ..... 219/620
5,970,209 A * 10/1999 Toyokura ..... 392/307
5,979,301 A 11/1999 Perttola
5,996,572 A * 12/1999 Ilagan ..... 126/25 AA
6,000,318 A 12/1999 Weiss et al.
6,029,751 A * 2/2000 Ford et al. ..... 169/60
6,123,011 A 9/2000 Cretors
6,131,822 A * 10/2000 Farmer, Jr. ..... 239/288
6,135,011 A 10/2000 Hodgson et al.
6,164,192 A 12/2000 Stein et al.
6,164,193 A * 12/2000 Perttola ..... 99/323.9
6,234,063 B1 * 5/2001 Evers et al. ..... 99/323.7
6,360,825 B1 * 3/2002 Padgett et al. ..... 169/65
6,374,727 B1 4/2002 Cretors
6,382,087 B1 5/2002 Iiyama
6,412,395 B1 7/2002 Weiss et al.
6,412,396 B1 7/2002 Wright
6,483,687 B2 * 11/2002 Katooka et al. ..... 361/142
6,534,103 B2 3/2003 Weiss
6,578,468 B1 6/2003 Horn
6,615,820 B1 * 9/2003 Ferreira et al. ..... 126/25 B
6,672,201 B2 * 1/2004 Evans et al. ..... 99/323.7
6,689,996 B2 * 2/2004 Shon et al. ..... 219/707
6,730,891 B1 * 5/2004 Redmon ..... 219/510
6,752,071 B1 * 6/2004 Snyder ..... 99/323.5
6,829,982 B2 * 12/2004 Weiss et al. ..... 99/323.7
RE38,714 E * 3/2005 Pope, Jr. et al. ..... 361/103
6,866,103 B2 * 3/2005 Ballu ..... 169/91
6,872,923 B2 3/2005 Cretors et al.
6,914,226 B2 7/2005 Ottaway
7,004,084 B1 * 2/2006 Anderson et al. ..... 110/186
7,095,847 B2 * 8/2006 Tsuruya et al. ..... 379/399.02
7,422,011 B2 * 9/2008 Bachinski et al. ..... 126/521
7,864,510 B2 * 1/2011 Renzo ..... 361/679.01
7,874,244 B2 1/2011 Rhome
8,027,752 B2 * 9/2011 Castaldo et al. ..... 700/296
2001/0025846 A1 * 10/2001 Kochman et al. ..... 219/545
2002/0038795 A1 * 4/2002 Katooka et al. ..... 219/130.21
2002/0184786 A1 * 12/2002 Miller, II ..... 34/132
2003/0159591 A1 8/2003 Evans et al.
2004/0200394 A1 * 10/2004 Krumrei ..... 110/347
2004/0265993 A1 12/2004 Darling et al.
2005/0167425 A1 * 8/2005 Yamauchi et al. ..... 219/757
2006/0043087 A1 * 3/2006 Gagas et al. ..... 219/391
2006/0049172 A1 * 3/2006 Gagas et al. ..... 219/521

(56) References Cited

U.S. PATENT DOCUMENTS

| | | | | |
|---|---|---|---|---|
| 2006/0052905 | A1* | 3/2006 | Pfingsten et al. | 700/286 |
| 2006/0144245 | A1* | 7/2006 | Rhome | 99/323.5 |
| 2007/0103833 | A1* | 5/2007 | Harris, IV | 361/103 |
| 2007/0169948 | A1* | 7/2007 | Vidojevic et al. | 169/65 |
| 2009/0041915 | A1 | 2/2009 | Biechteler | |
| 2009/0126579 | A1 | 5/2009 | Cretors et al. | |
| 2009/0223378 | A1 | 9/2009 | Cretors | |
| 2009/0260249 | A1* | 10/2009 | Renzo | 34/201 |
| 2011/0027434 | A1 | 2/2011 | Cretors | |
| 2011/0076372 | A1 | 3/2011 | Cretors | |
| 2011/0076373 | A1 | 3/2011 | Cretors et al. | |

OTHER PUBLICATIONS

Forney et al., "Applications: Understanding Fire and Smoke Flow Through Modeling and Visualization," IEEE Computer Society, Jul./Aug. 2003.

International Search Report and Written Opinion, PCT/US07/60891; Mailed on Mar. 13, 2008; Applicant: C. Cretors and Company, 8 pages.

Non-Final Office Action; U.S. Appl. No. 11/340,070; Mailed on Oct. 27, 2008, 10 pages.

Owner's Guide, Restaurant Fire Suppression System, Ansul Inc., Copyright 1998.

* cited by examiner

FIRE CONTAINMENT SYSTEM

CROSS-REFERENCE TO RELATED APPLICATION

The present application is a divisional of U.S. patent application Ser. No. 11/340,070, filed Jan. 26, 2006, the disclosure of which is incorporated herein by reference in its entirety.

BACKGROUND OF THE INVENTION

1. Field of the Invention

This invention relates to a system and method of containing a fire within a semi-enclosed space.

2. Discussion of the Prior Art

Fire suppression is an important consideration in mechanical equipment housings. This is especially true with respect to a cooking apparatus, such as an oven, fryer, or griddle. For example, in the field of popcorn machines, fire is a risk because popcorn requires heating corn and oil to produce popcorn. Typically popcorn is prepared in a kettle contained in a cabinet. The kettle contains an electrical heating element which heats the corn and oil to produce popcorn.

In the case of a fire, prior art systems are available to provide power cutoff, but for maximum protection, it is desirable for the fire to be contained within the semi-enclosed space as long as possible to protect a user as well as to provide time to put out the fire. In order to comply with newer safety regulations, the advent of fire must be contained within a certain period of time while fire suppression systems, such as are commercially available from Ansul Incorporated, are activated. The containment of fire within a certain area within a machine is particularly challenging because in a semi-enclosed space, after a fire consumes the available oxygen available within that space, the fire will escape outside the semi-enclosed space in order to seek fresh combustion air to continue the fire. Prior art systems tend to try to reduce the amount of air available, under the theory that a fire cannot continue without more air for combustion. However, given the semi-enclosed nature of such equipment, such prior art systems suffer from the fact that the fire seeks to expand out of the semi-enclosed space to continue the combustion. Unfortunately, this is the same area in which an operator is most likely to be located when trying to control the fire or access controls on the machine to shut off the cooking element. Thus, this tendency of the fire to surge outward is particularly dangerous to any nearby operators, as well as to the nearby surroundings.

Considering these disadvantageous features of prior art systems, there is a need for a fire containment system that intentionally directs fire away from an open side of a semi-enclosed space. There further is a need for a fire containment system that supplies a source of combustion air within the semi-enclosed space to direct the fire toward a rear wall, providing enhanced safety to nearby operators and surroundings, as well as increased time to control and extinguish the fire.

The present invention addresses shortcomings in prior art fire containment systems, while providing the above mentioned desirable features.

SUMMARY OF THE INVENTION

The purpose and advantages of the present invention will be set forth in and apparent from the description and drawings that follow, as well as will be learned by practice of the invention.

The present invention is generally embodied in a fire containment system. In a first aspect of the invention, a fire containment system is provided for containing the outbreak of a fire in a semi-enclosed space, where the semi-enclosed space is defined by at least two side panels, a back panel, a top panel and a bottom panel. The system has a first vent in communication with the semi-enclosed space and a first blower adapted to exhaust air from the semi-enclosed space through the first vent. The system also has a second vent located in the top panel in communication with the semi-enclosed space and being disposed opposite an open side of the semi-enclosed space, and a second blower adapted to direct air into the semi-enclosed space through the second vent. The system is adapted such that if a fire starts in the semi-enclosed space, the first blower exhausts combustion air from the semi-enclosed space through the first vent while the second blower provides a source of combustion air to the semi-enclosed space through the second vent, thereby encouraging the fire to stay within the semi-enclosed space.

In a second aspect of the invention, a cooking apparatus is provided having a fire containment system, the cooking apparatus comprising a semi-enclosed cooking space defined by at least two side panels, a back panel, a bottom panel, a top panel and a front that may be opened between the two side panels, a cooking surface having at least one heating element and being located within the semi-enclosed cooking space, a first vent in the top panel above and in communication with the semi-enclosed cooking space, a first blower adapted to exhaust air from the semi-enclosed cooking space through the first vent, a second vent located in the top panel above and in communication with the semi-enclosed cooking space, a second blower adapted to direct air into the semi-enclosed cooking space through the second vent and proximate the back panel, a temperature sensitive coupling adapted to detect the presence of fire and to turn off the at least one heating element, and wherein if a fire ignites in the semi-enclosed cooking space, the first blower continues to operate to exhaust the combustion gases while the second blower provides air for combustion within the semi-enclosed cooking space, encouraging the fire to stay within the semi-enclosed cooking space.

In another aspect of the invention, a method of containing an outbreak of fire within a semi-enclosed space is disclosed where the semi-enclosed space is defined by at least two side panels, a back panel, a bottom panel, and a top panel and having an open front between the two side panels. The method includes providing an exhaust vent in communication with the semi-enclosed space, providing a first blower in communication with the exhaust vent, exhausting air from the semi-enclosed space through the exhaust vent via the first blower, providing an inlet air vent in communication with the semi-enclosed space, providing a second blower in communication with the inlet air vent, providing air to the semi-enclosed space through the inlet air vent via the second blower, providing a temperature sensitive coupling adapted to decouple at a pre-selected temperature, providing electrical circuitry to control the interaction between a heating element, the temperature sensitive coupling, and the first and second blowers, and wherein if a fire starts in the semi-enclosed space, the temperature sensitive coupling decouples the heating element, while power continues to be supplied to the first and second blowers and the first blower exhausts combustion gases while the second blower provides inlet air to the semi-enclosed space wherein the fire is kept from spreading beyond the semi-enclosed space.

In yet another aspect of the invention, at least one nozzle is directed toward the semi-enclosed space, and the nozzle is adapted to spray fire extinguishing material.

Thus, the present invention provides an alternative to prior art fire containment methods and systems. The present invention uses a counter-intuitive system which seeks to feed combustion air to a fire within a particular location of a semi-enclosed space, so as to encourage the fire to remain within the semi-enclosed space. This system reduces the air handling capacity required to exhaust the combustion gases present in the event of a fire, because the fire is less likely to expand outward from beneath a hood unit located over the semi-enclosed space. Indeed, because the fire containment system results in a smaller, more localized fire, a hood unit having a somewhat reduced air flow capacity may be used. The new method and system improve the ability to handle the outbreak of a fire, while providing critically important increased time for the fire to be extinguished by a fire suppression system which is automated or manually activated by an operator.

It is to be understood that both the foregoing general description and the following detailed description are not limiting but are intended to provide further explanation of the invention claimed. The accompanying drawings, which are incorporated in and constitute part of this specification, are included to illustrate and provide a further understanding of the method and system of the invention. Together with the description, the drawings serve to explain the principles of the invention.

BRIEF DESCRIPTION OF DRAWINGS

These and further aspects and advantages of the invention will be discussed more in detail hereinafter with reference to the disclosure of preferred embodiments, and in particular with reference to the appended Figures. In describing the preferred embodiments, reference is made to the accompanying drawing Figures wherein like parts have like reference numerals, and wherein.

Figure 1:
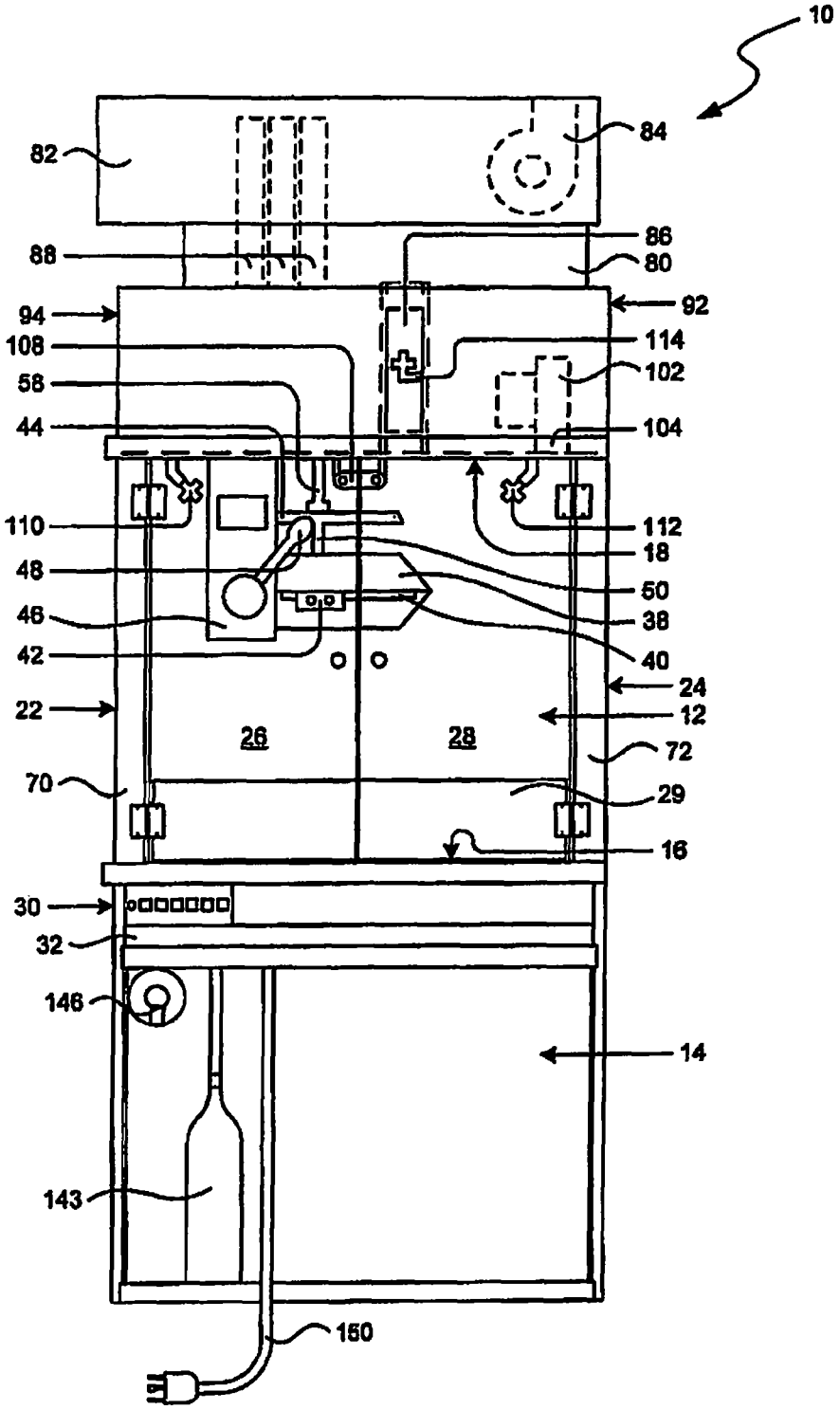
FIG. 1 is a front view of a cooking apparatus having a semi-enclosed space and a fire containment system in accordance with the present invention.

It should be understood that the drawings are not to scale and provide examples involving a fire containment system within the scope and spirit of the present invention. While considerable mechanical details of such a system, including other plan and section views of the particular components, have been omitted, such details are considered well within the comprehension of those skilled in the art in light of the present disclosure. It also should be understood that the present invention is not limited to the preferred embodiments illustrated.

DESCRIPTION OF THE PREFERRED EMBODIMENTS

While the present invention is capable of embodiment in various forms, there is shown in the drawings and will hereinafter be described a two presently preferred embodiments with the understanding that the present disclosure is to be considered as an exemplification of the invention, and is not intended to limit the invention to the specific embodiments illustrated.

FIGS. 1-5B show a first embodiment of a cooking apparatus having a semi-enclosed space in the form of a popcorn machine 10, which incorporates a fire containment system in accordance with the present invention. It should be understood that machine 10 is presented as just one example of a cooking apparatus with a fire containment system that can be used with any such semi-enclosed space. Popcorn machines are generally stand-alone units which are used for intermittent or continuous production of popcorn. In this example, machine 10 includes a semi-enclosed space in the form of a popcorn case or cabinet 12 within which popcorn is both produced and stored. Popcorn case 12 is mounted on a storage cabinet 14 which allows storage of materials and supplies for machine 10, and which is shown with its front sliding cabinet doors removed.

Popcorn case 12 preferably has a semi-enclosed space defined by a series of panels or walls. The term wall or panel used in this context is intended to mean a boundary which may or may not be a planar surface. Thus, "panel" is intended to include structures such as physical building walls, but also could include a variety of other shapes and features, such as the inside of a concave hood, or other obstructions and structures, such as a top of a stove unit having burners or other heating elements. Thus, in a broad sense, popcorn case 12 is representative of a semi-enclosed space having a bottom panel 16, a top panel 18, a back panel 20, and a pair of side panels 22 and 24, which collectively define the semi-enclosed space. Back panel 20 and side panels 22 and 24 are typically made of stainless steel or other opaque materials. Alternatively, these panels may be constructed of tempered glass, plexiglass or other transparent or semi-transparent materials to allow a view of the popping process, as well as the completed popcorn which is stored in popcorn case 12. In this example, access to popcorn case 12 is provided by means of a pair of hinged doors 26 and 28, which may also be made of plexiglass or other suitable materials, to permit the operator to carry out cooking operations and to dispense popcorn when desired. It will be appreciated that doors 26 and 28 are able to be opened to gain access to the semi-enclosed space, as needed, and that in some variations, the front may simply remain open, such as in the case of a griddle, or may use a single door. A tiltable drop-down shelf 29 spans the front opening to retain popped popcorn when doors 26 and 28 are opened.

Figure 5A:
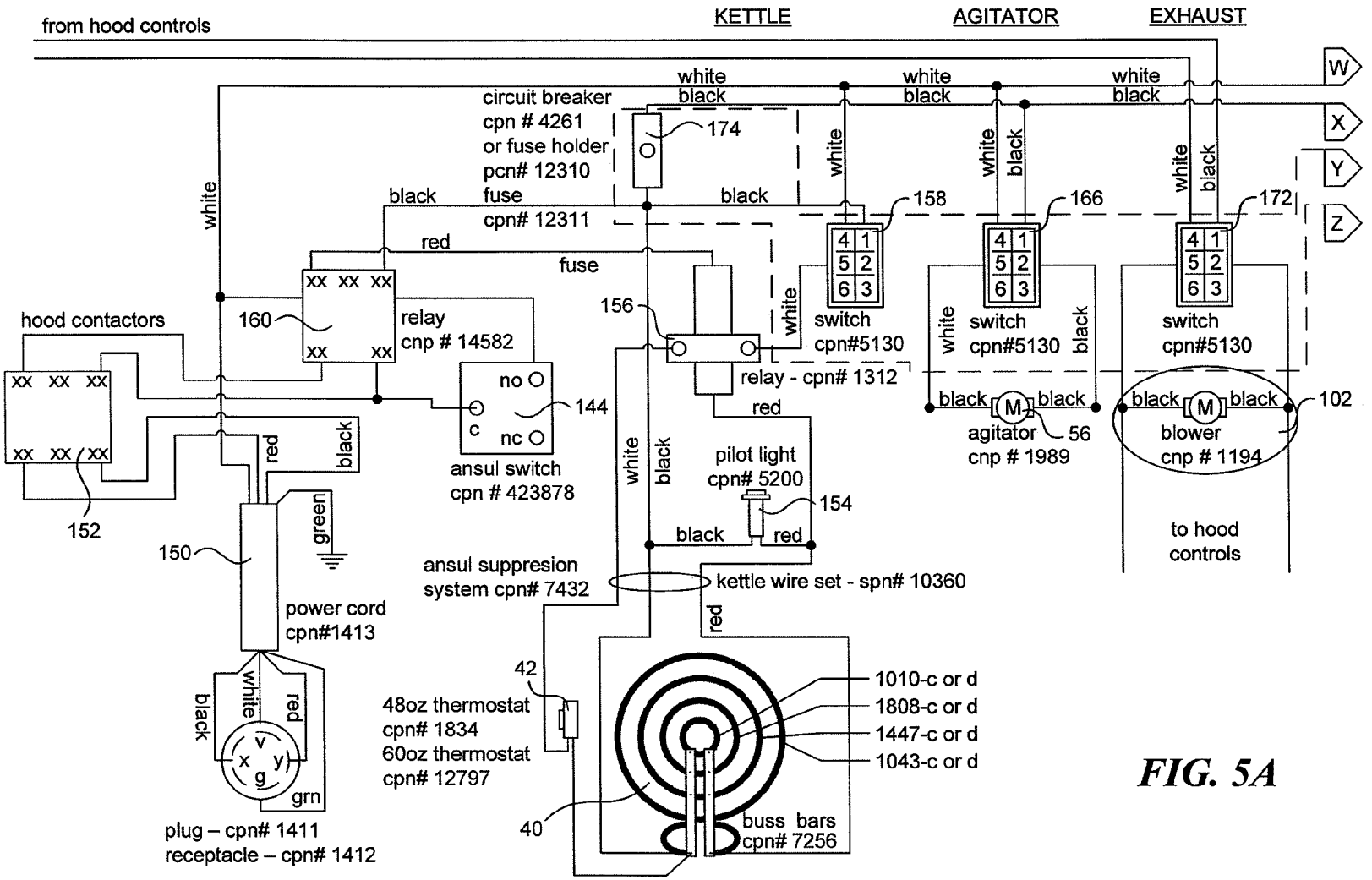
FIGS. 5A and 5B are first and second portions of an electrical circuit diagram for the machine and fire containment system for the embodiment in FIG. 1.
Figure 5B:
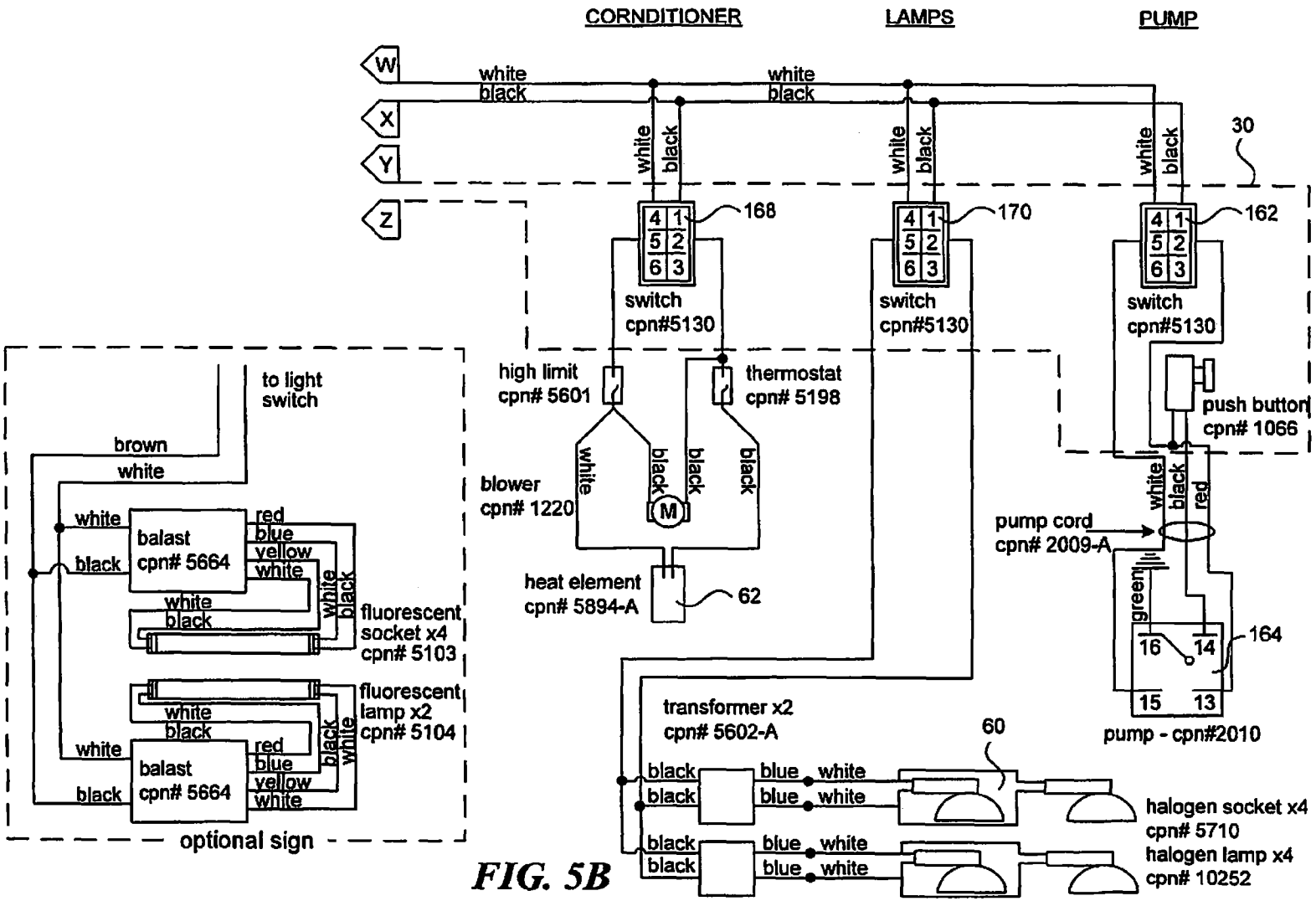

A control unit 30 also is mounted under the bottom panel 16, between popcorn case 12 and the storage section 14, and behind a control panel 32. Control panel 32 has buttons or switches by which control unit 30 can be activated. Circuitry involving control unit 30 is shown in FIGS. 5A and 5B, and will be discussed further herein.

In machine 10, popcorn kernels are placed into a kettle 38 which is suspended from top panel 18 of case 12. It will be appreciated that kettle 38 alternatively may be suspended on a pedestal or from an arm that would be attached to a cabinet back or side panel. Kettle 38 is constructed of stainless steel or nickel plated steel. Kettle 38 has one or more electric heating elements 40 located in its walls, but it will be appreciated that heating elements for the purpose of cooking may be electric or may be supplied with combustible fuel sources, such as a propane gas burner. In the present embodiment, heating elements 40, when activated, are utilized to heat oil contained within kettle 38 and to pop the kernels of corn placed into kettle 38 by an operator. A thermostat 42 is located on kettle 38 to sense the temperature of kettle 38.

Kettle 38 is supported on a pivot axis (not shown) carried within a support column 46 extending from top wall 18 of popcorn case 12. A kettle dump handle 48 is connected to the pivot axis of kettle 38, so that by rotating dump handle 48, kettle 38 may be tipped on the pivot to allow popped popcorn to be discharged from kettle 38 into popcorn case 12.

Kettle 38 has a cover 44 which is circular in shape and is suspended by means of a support rod 50 which extends through the center of cover 44. Support rod 50 encloses a drive shaft (not shown) as part of an agitator 56 which includes a motor that drives a number of mixing blades in the kettle (not shown). The agitator 56 is used to agitate the kernels in kettle 38, to ensure more even cooking. Kettle cover 44 may be opened via a cover lift rod 58 to add kernels. Popcorn machine 10 has lights 60 which are used to illuminate case 12. Machine 10 also has a warmer unit 62 which uses a heating element to maintain the warmth of popped popcorn in case 12.

Figure 4:
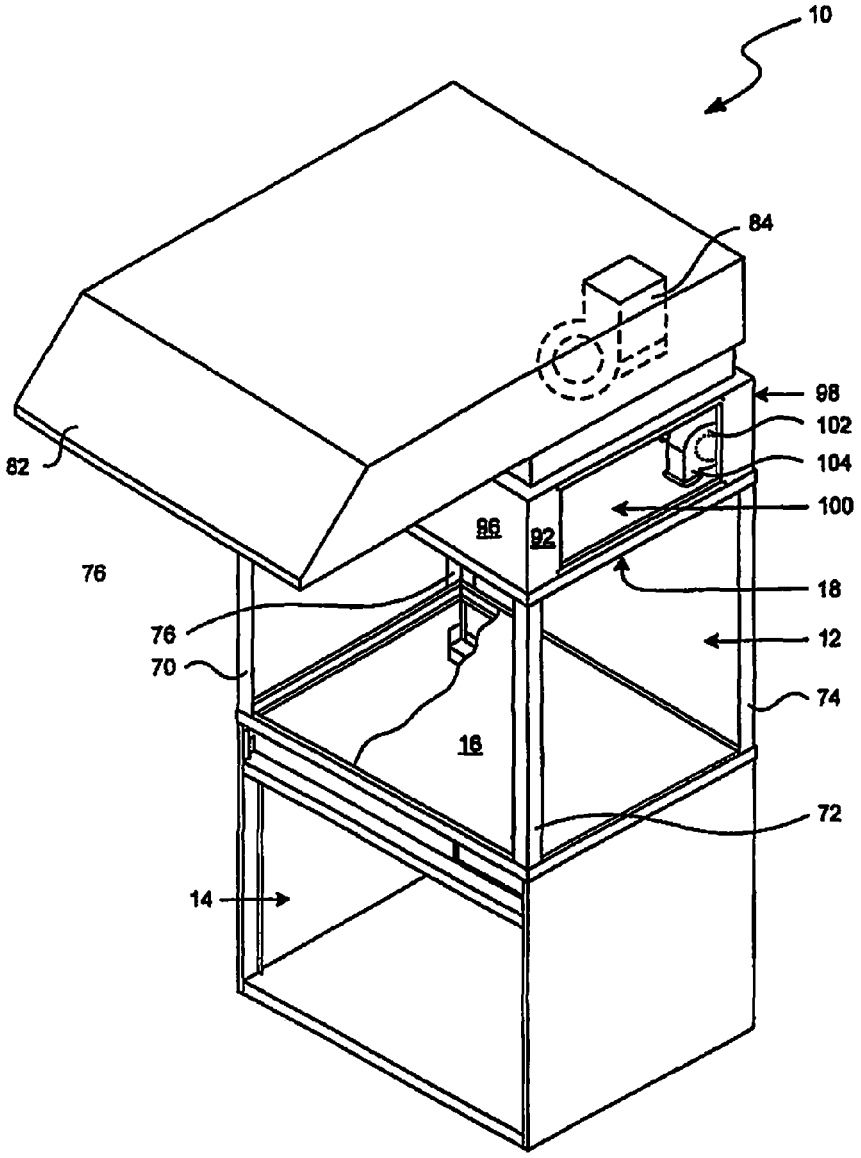
FIG. 4 is a perspective view of portions of the embodiment in FIG. 1.

As best seen in FIG. 4, this particular popcorn cabinet 12 has four corner support members 70, 72, 74 and 76. Corner support members 70, 72, 74 and 76 provide a frame for mounting side panels 22 and 24, back panel 20, and doors 26 and 28. A vent support housing 78 is mounted on top of case 12, above top panel 18, for intake air handling and a location to house the agitator motor and other components. A hood housing 80 is mounted on vent support housing 78 for venting exhaust from the interior of case 12.

Hood housing 80 includes a metallic hood 82 which extends over popcorn case 12 to contain heat from case 12 and to prevent any potential flame from coming into direct contact with a ceiling or anything above the hood. Hood housing 80 contains an exhaust blower 84 which serves to vent exhaust gases from semi-enclosed popcorn case 12. Thus, any undesirable odors may be reduced and airborne oils eliminated from the area around machine 10. Exhaust blower 84 preferably is of a squirrel cage configuration, such as is available from Fasco, but may be of other suitable configurations.

Figure 3:
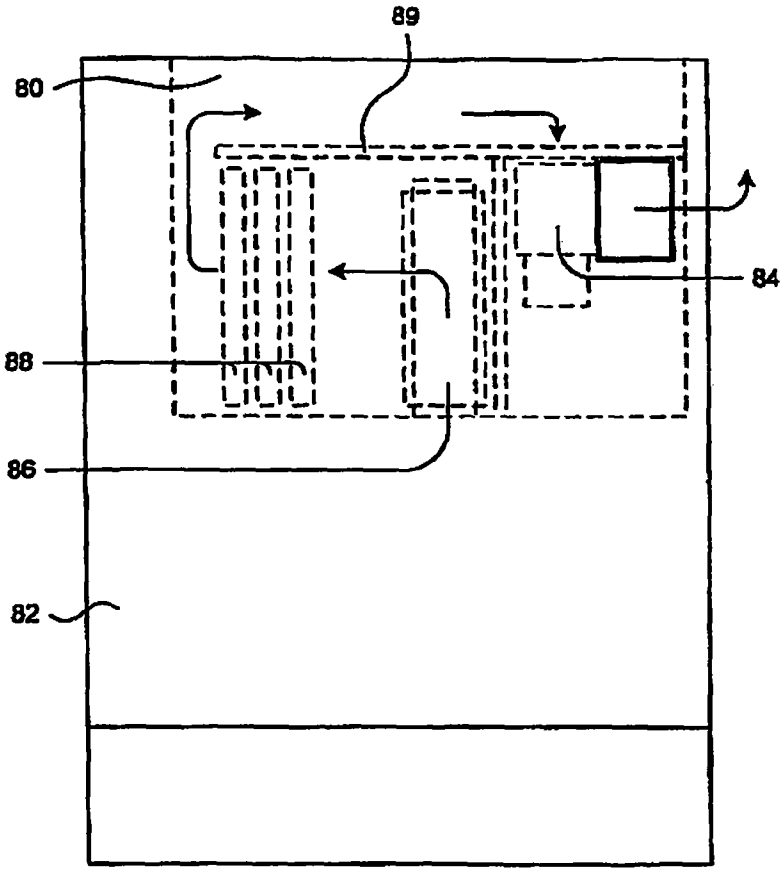
FIG. 3 is a top view of portions of the embodiment in FIG. 1.
Figure 2:
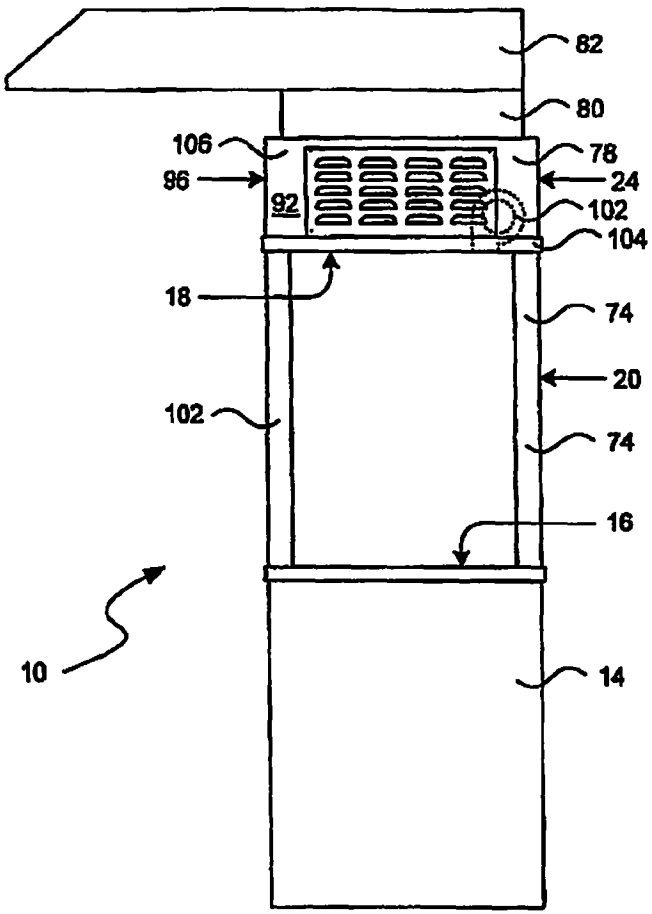
FIG. 2 is a side view of portions of the embodiment in FIG. 1.

Vent support housing 78 is located between top panel 18 and hood housing 80. Vent support housing 78 has a pair of side panels 92 and 94, a front panel 96 and a rear panel 98. Vent support housing 78 has an intake vent 86 which provides exhaust air access between case 12 and hood housing 80. Vent 86 preferably directs heat and exhaust gases from the semi-enclosed space of case 12, through a three filter system 88 including charcoal, electro-static and grease filters, and around a partition 89 to reach exhaust blower 84, as best seen in FIG. 3. Exhaust blower 84 is coupled to and controlled by control unit 30, and exhausts filtered air to the space above hood 82.

A fresh air blower 102 is mounted near rear panel 98 of vent support housing 78. Fresh air blower 102 provides additional fresh air into case 12 and is controlled by control unit 30 to continuously operate. The air flow generated by blower 102 is circulated through a secondary vent 104 which is located in top panel 18 of case 12. A removable side access 106 serves as an inlet source of fresh air to blower 102, and allows maintenance access to blower 102, as well as the other components housed in vent support housing 78. As with exhaust blower 84, fresh air blower 102 preferably is of a squirrel cage configuration, such as is available from Fasco, although alternative configurations may be used. It will be appreciated that depending on the desired installation configuration, the vents associated with blowers 84 or 102 essentially may be formed by the housing of the respective blower unit, such as with vent 104.

Machine 10 has a fire containment system which is activated if the temperatures in case 12 exceeds a certain pre-selected threshold temperature as will be explained further herein. A temperature sensitive coupling 108 is installed above kettle 38 in the form of a fusible link, as seen in FIG. 1. Coupling 108 has a portion which will melt at a threshold temperature which is indicative of the presence of a fire, and via its connection to relay 160, decouples an electrical circuit to control unit 30. It will be appreciated that other coupling or triggering devices besides a fusible link may be used, however, it is preferable to use the fusible link arrangement as it is already available in systems from Ansul Incorporated.

A pair of nozzles 110 and 112 are installed in the top of case 12, and another nozzle 114 is installed in vent 86. Nozzles 110, 112 and 114 are provided to spray a fire extinguishing material or composition, as is provided preferably by a fire suppression system such as by Ansul Incorporated. In this system, nozzles 110, 112 and 114 are supplied with a fire extinguishing agent, such as $CO_2$ or foam, via a storage tank 143 which preferably is stored in cabinet 14, with tubular connections routed up through corner support members 70, 72, 74 or 76, and within vent support housing 78, as needed.

A power cord 150 is connected to control unit 30 to provide machine 10 with the necessary electrical power to operate the various components. Power cord 150 is a conventional four line power cord which may be plugged into a normal 208/240 volt power source. All of the machine elements described above are operatively interconnected and functionally controlled by control unit 30, as shown in FIGS. 5A and 5B. Control unit 30 is activated by buttons or switches mounted on a control panel 32. Immediately under control panel 32 is a fire suppression override button or switch 146, which allows a user to quickly disconnect power to pre-selected particular electrical components in machine 10 and activate the fire suppression system and discharge an extinguishing agent from nozzles 110, 112 and 114.

Power cord 150 provides power for the electrical components of machine 10. Power cord 150 is electrically connected to components within hood housing 80. In essence, power is supplied via power cord 150 to a switch 172 which controls the power to blowers 102 and 84 via a hood contact junction 152. Hood contact junction 152 is located in hood housing 80 and is coupled to the electrical components in control unit 30, such that power comes in to contact junction 152 and then flows to control unit 30. Thermostat 42 is coupled to a pilot light 154 and a relay 156. Relay 156 is controlled by a kettle switch 158 which allows the user to connect power to heating elements 40 of kettle 38 to cook and thereby pop the popcorn. Thermostat 42 is programmed to interrupt power to heating elements 40 after a pre-selected temperature is reached which is designed to pop the popcorn. It will be appreciated that alternative heating and thermostatic circuitry could be employed, such as is disclosed in U.S. Pat. No. 6,872,923.

Hood contact junction 152 is coupled to a relay 160, which in turn is coupled to emergency fire suppression override switch 146. If switch 146 is pulled, further switch 144 for the suppression system is triggered interrupting relay 160, and thereby interrupting power from hood contact junction 152 to particular electrical components controlled by control unit 30. Relay 160 also is mechanically coupled via fusible link 108, such that if fusible link 108 melts due to the excessive heat caused by a fire, relay 160 will be decoupled or tripped, interrupting power from hood contact junction 152 to control unit 30.

Control unit 30 allows activation and deactivation of various features of machine 10. A pump switch 162 is coupled to control unit 30 and activates an oil pump 164 to pump oil into kettle 38, while heating elements 40 heat kettle 38 to pop the corn. An agitator switch 166 controls operation of agitator 56. A conditioner switch 168 controls warmer unit 62 and a lights switch 170 controls lights 60. These types of components are disabled if power from contact junction 152 to control unit 30 is interrupted.

Importantly, in the event of a fire or when emergency switch 146 is pulled, while the power is decoupled or shut off from heating elements 40 and other electronic components controlled by control unit 30, power continues to flow to blowers 102 and 84 through contact junction 152 in hood housing 80. Thus, power is not interrupted to blowers 102 and 84, even when relay 160 is tripped. A further safety fuse 174 also is provided in series with the power lines to the electrical components to avoid potential electrical overloads.

Fusible link 108 is provided to trigger relay 160 which controls the switches 158, 162, 166, 168 and 170 and heating elements 40. Fusible link 108 is selected to melt or break, thereby triggering relay 160, at an appropriate temperature which indicates combustion or fire in cabinet 12. Hence, with the fire containment system of the present invention, if fusible link 108 melts, power is immediately interrupted to all components except exhaust blower 84 and inlet air blower 102. Blower 102 provides inlet air via vent 104 to contain a fire within case 12, while the exhaust blower 84 removes the combustion products, such as heat and smoke, via vent 86. It also will be appreciated that if the heating elements are alternatively associated with a combustible fuel, such as a propane gas burner on a cooktop, the circuitry may be designed to activate closure of a gas valve, shutting off the flow of gas to the heating element, in the event that a fire is sensed in the semi-enclosed space.

Contrary to the conventional thinking that it is unwise to provide air to an unwanted fire, the fire containment system of the present invention contains a fire by providing a specifically located source of air for combustion via blower 102 and vent 104. The fire thus is drawn toward vent 104 which is located near the rear of case 12, rather than escaping the bounds of the semi-enclosed space of case 12. These actions, which encourage the fire to stay within the semi-enclosed space, create highly advantageous additional fire containment time, and allow foam or another flame extinguishing material to be applied via nozzles 110, 112 and 114, to extinguish the fire. Depending on the particular requirements of the user, inlet air blower 102 may be configured to automatically shut off once fire extinguishing material has been applied to the semi-enclosed space, or on a time-delayed circuit. Similarly, exhaust blower 84 may be configured to automatically shut off on a time-delayed circuit.

Figure 6:
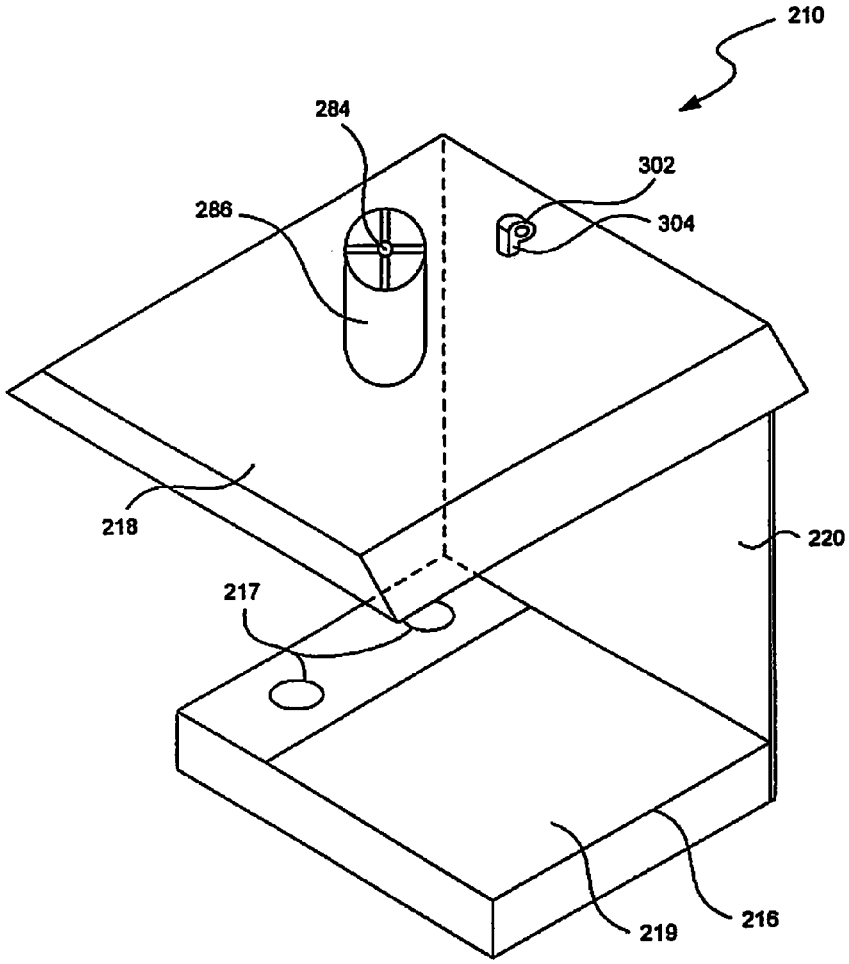
FIG. 6 is a perspective view of a second embodiment having a semi-enclosed space and a fire containment system in accordance with the invention.
Figure 7:
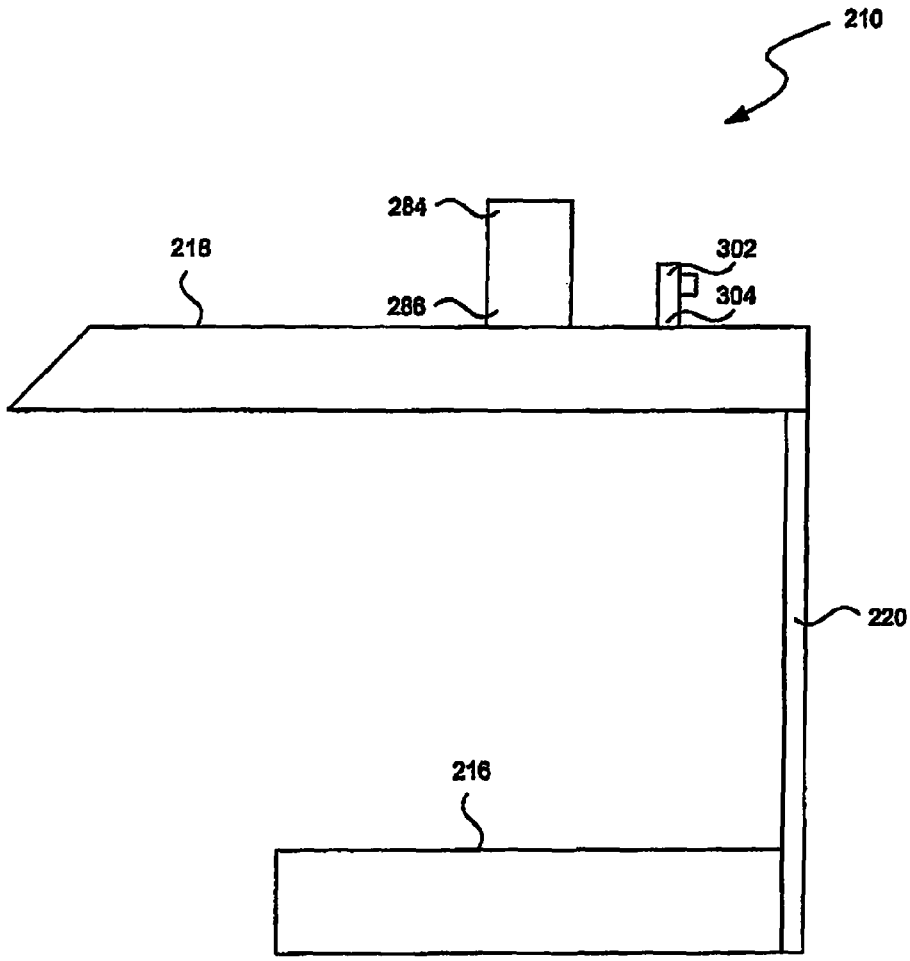
FIG. 7 is a side view of portions of the embodiment in FIG. 6.

Turning to FIGS. 6 and 7, an alternative semi-enclosed space is shown and defined by way of simple schematic drawings of a cooking apparatus 210 having a bottom panel 216, a top panel 218 and a rear panel 220. These drawings have been greatly simplified for brevity purposes, and it will be understood that in this alternative embodiment, the bottom panel 216 further includes propane gas burners 217 and a planar griddle cooking surface 219. It will be appreciated that the features and apparatus described above in relation to machine 10 similarly may be employed to adopt the fire containment system of the present invention to an alternative hardware, such as cooking apparatus 210. Thus, containment of a fire in the above-defined semi-enclosed space may be enhanced by use of the system which would include an exhaust blower 284 in communication with the semi-enclosed space via an exhaust vent 286, in combination with use of an inlet air blower 302 in communication with the semi-enclosed space via inlet air vent 304. Accordingly, power to particular electrical components and the source for heating elements in burners 217 and griddle 219 would be interrupted in the event of a fire, while blowers 284 and 302 would continue to operate, thereby enhancing fire containment in route to eventual activation of the nozzles in the fire suppression system to extinguish the fire.

It will be apparent to those skilled in the art that the fire containment method and system in accordance with the present invention may be provided in various configurations without departing from the spirit or scope of the invention. Any variety of suitable materials of construction, configurations, shapes and sizes for the components and methods of connecting the components may be utilized to meet the particular needs and requirements of an end user in constructing a fire containment system consistent with the present invention. Thus, the present invention is not limited by the foregoing descriptions but is intended to cover all modifications and variations that come within the scope and spirit of the invention and the claims that follow.

What is claimed is:

1. A popcorn machine comprising:

a popcorn case having a semi-enclosed cooking space defined by at least two side panels, a back panel, a bottom panel, and a top panel;

a popcorn kettle positioned within the semi-enclosed cooking space, wherein the popcorn kettle includes a cooking surface having at least one heating element associated therewith;

a first vent positioned above and in communication with the semi-enclosed cooking space;

a first blower operably coupled to the first vent to remove air from within the semi-enclosed cooking space through the first vent;

a second vent positioned in communication with the semi-enclosed cooking space;

a second blower operably coupled to the second vent to flow fresh air from outside the popcorn case into the semi-enclosed cooking space through the second vent;

a temperature sensor configured to detect a presence of a fire within the semi-enclosed cooking space; and a power circuit operably connected to the temperature sensor, the heating element, the first blower, and the second blower, wherein the power circuit interrupts power to the heating element and maintains power to the first and second blowers in response to detecting the presence of the fire by the temperature sensor, whereby the first blower continues to remove air from within the semi-enclosed cooking space through the first vent in the presence of the fire and the second blower continues to flow fresh air into the semi-enclosed cooking space through the second vent in the presence of the fire.

2. A popcorn machine comprising:

a popcorn case having a semi-enclosed cooking space defined by at least two side panels, a back panel, a bottom panel, and a top panel;

a popcorn kettle positioned within the semi-enclosed cooking space, wherein the popcorn kettle includes a cooking surface having at least one heating element associated therewith;

a first vent positioned above and in communication with the semi-enclosed cooking space;

a first blower operably coupled to the first vent to remove air from within the semi-enclosed cooking space through the first vent;

a second vent positioned in communication with the semi-enclosed cooking space, wherein the second vent is positioned in the top panel of the popcorn case adjacent to the back panel and opens directly into the semi-enclosed cooking space;

a second blower operably coupled to the second vent to flow fresh air from outside the popcorn case into the semi-enclosed cooking space through the second vent;

a temperature sensor configured to detect a presence of a fire within the semi-enclosed cooking space; and a power circuit operably connected to the temperature sensor, the heating element, the first blower, and the second blower, wherein the power circuit interrupts power to the heating element and maintains power to the first and second blowers in response to detecting the presence of the fire by the temperature sensor, whereby the first blower continues to remove air from within the semi-enclosed cooking space through the first vent in the presence of the fire and the second blower continues to flow fresh air into the semi-enclosed cooking space through the second vent in the presence of the fire.

3. The popcorn machine of claim 1 wherein the temperature sensor includes a fusible link configured to melt at a preselected temperature.

4. The popcorn machine of claim 1 wherein the temperature sensor is positioned above the popcorn kettle in the popcorn case.

5. The popcorn machine of claim 1 wherein the power circuit includes a power source operably coupled to the heating element, the first blower, and the second blower, wherein the power source is automatically decoupled from the heating element while remaining operably coupled to the first and second blowers, in response to detecting the presence of the fire by the temperature sensor.

6. The popcorn machine of claim 1 wherein the power circuit includes:

a power source operably coupled to the heating element, the first blower, and the second blower; and a relay operably coupled to the temperature sensor and the power source, wherein the relay automatically decouples the power source from the heating element while the power source remains operably coupled to the first and second blowers, in response to detecting the presence of the fire by the temperature sensor.

7. The popcorn machine of claim 1, further comprising a hood unit positioned above the semi-enclosed cooking space, wherein the hood unit includes a power source operably connected to the heating element, the first blower, and the second blower, and wherein the power source is automatically decoupled from the heating element in response to detecting the presence of the fire by the temperature sensor.

8. The popcorn machine of claim 1, further comprising at least one nozzle responsive to the temperature sensor and directed toward the semi-enclosed cooking space, wherein the nozzle is configured to spray flame extinguishing material into the semi-enclosed cooking space in response to detecting the presence of the fire by the temperature sensor.

9. The popcorn machine of claim 1:

wherein the popcorn kettle is suspended from the top panel of the popcorn case;

wherein the second vent is positioned between the popcorn kettle and the back panel of the popcorn case;

wherein the temperature sensor includes a fusible link configured to melt at a preselected temperature, wherein the fusible link is positioned above the popcorn kettle in the popcorn case; and wherein the power circuit includes:

a power source operably coupled to the heating element, the first blower, and the second blower; and a relay operably coupled to the power source and the fusible link, wherein the relay automatically decouples the power source from the heating element when the fusible link melts in response to the presence of the fire in the semi-enclosed cooking space, and wherein the power source remains operably coupled to the first and second blowers when the fusible link melts, thereby causing the first blower to continue removing air from within the semi-enclosed cooking space through the first vent in the presence of the fire and the second blower to continue flowing fresh air into a rear portion of the semi-enclosed cooking space in the presence of the fire.

10. A popcorn machine comprising:

a popcorn case having an interior space defined at least in part by two side panels, a back panel, a top panel and a bottom panel;

a popcorn kettle positioned in the interior space;

a fire containment system including:

a first vent in communication with the interior space;

a first blower configured to exhaust air from the interior space through the first vent;

a second vent in communication with the interior space; and a second blower configured to direct fresh air from outside the popcorn case into the interior space through the second vent;

a heating element operably associated with the popcorn kettle;

a power source operably coupled to the heating element, the first blower, and the second blower; and a coupling configured to automatically decouple the power source from the heating element while maintaining power to the first and second blowers in the event of a fire in the interior space;

wherein if a fire is present in the interior space, the fire containment system maintains power to the first blower and the second blower, whereby the first blower exhausts air and combustion products from the interior space through the first vent in the presence of the fire while the second blower provides fresh air to the interior space through the second vent in the presence of the fire, thereby facilitating containment of the fire to the interior space.

11. The popcorn machine of claim 10, wherein the coupling includes a fusible link configured to melt at a pre-selected temperature and automatically decouple the power source from the heating element while maintaining power to the first and second blowers in the event of a fire in the interior space.

12. The popcorn machine of claim 10 wherein the second vent is positioned in the top panel between the popcorn kettle and the back panel of the popcorn case.

13. The popcorn machine of claim 10, further comprising at least one nozzle directed toward the interior space and configured to spray fire extinguishing material in the event of a fire in the interior space.

14. A method of controlling a fire in a popcorn machine, the method comprising:

providing a popcorn machine having a popcorn kettle and a heating element in a semi-enclosed space;

providing an exhaust vent in communication with the semi-enclosed space;

providing an inlet air vent in communication with the semi-enclosed space;

providing power to the heating element to pop corn in the popcorn kettle;

while providing power to the heating element:

providing power to a first blower in communication with the exhaust vent to remove air from the semi-enclosed space through the exhaust vent; and providing power to a second blower in communication with the inlet air vent to flow fresh air into the semi-enclosed space through the inlet air vent;

detecting a presence of a fire within the semi-enclosed space;

in response to detecting the presence of the fire within the semi-enclosed space:

automatically stopping power to the heating element;

continuing to provide power to the first blower to continue removing air from the semi-enclosed space through the exhaust vent in the presence of the fire; and continuing to provide power to the second blower to continue flowing fresh air into the semi-enclosed space through the inlet air vent in the presence of the fire.

15. The method of claim 14, further comprising providing a temperature sensitive coupling, wherein detecting the presence of the fire within the semi-enclosed space includes breaking the temperature sensitive coupling at a pre-selected temperature.

16. The method of claim 14, further comprising:

providing a temperature sensor;

operably coupling the temperature sensor to a power source; and operably coupling the power source to the heating element, the first blower, and the second blower, wherein detecting the presence of the fire within the semi-enclosed space includes sensing the fire with the temperature sensor, and wherein automatically stopping power to the heating element includes decoupling the power source from the heating element in response to a signal from the temperature sensor.

17. The method of claim 14 wherein providing a popcorn machine includes providing a popcorn case having at least two side panels, a back panel, a bottom panel, and a top panel, and wherein providing an inlet air vent in communication with the semi-enclosed space includes providing the air inlet in the top panel between the popcorn kettle and the back panel.

18. The method of claim 14 wherein providing a popcorn machine includes providing a popcorn case having at least two side panels, a back panel, a bottom panel, and a top panel, and wherein providing power to a second blower to flow fresh air into the semi-enclosed space through the inlet air vent includes flowing the fresh air into a rear portion of the popcorn case adjacent the back panel.

19. The method of claim 14, further comprising:

providing a nozzle system operably coupled to a source of fire extinguishing material; and in response to detecting the presence of the fire within the semi-enclosed space, automatically activating the nozzle system to spray the fire extinguishing material on the fire.

* * * * *

UNITED STATES PATENT AND TRADEMARK OFFICE

CERTIFICATE OF CORRECTION

PATENT NO. : 8,651,014 B2
APPLICATION NO. : 12/417261
DATED : February 18, 2014
INVENTOR(S) : Nenad Vidojevic et al.

It is certified that error appears in the above-identified patent and that said Letters Patent is hereby corrected as shown below:

In the Drawings:

On sheet 4 of 7, in Figure 5A, Ref. numeral 7432, line 1, delete "suppresion" and insert -- suppression --, therefor.

Signed and Sealed this
Sixth Day of May, 2014

Michelle K. Lee

Michelle K. Lee
*Deputy Director of the United States Patent and Trademark Office*